US010104940B2

(12) United States Patent
Spampinato

(10) Patent No.: US 10,104,940 B2
(45) Date of Patent: Oct. 23, 2018

(54) PAINT FIXTURE FOR SHOE PORTIONS

(71) Applicant: NIKE, Inc., Beaverton, OR (US)

(72) Inventor: Juan-Pier A. Spampinato, Aloha, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 15/614,255

(22) Filed: Jun. 5, 2017

(65) Prior Publication Data

US 2017/0265597 A1 Sep. 21, 2017

Related U.S. Application Data

(62) Division of application No. 14/168,481, filed on Jan. 30, 2014, now Pat. No. 9,706,815.

(51) Int. Cl.

| | |
|---|---|
| ***A43D 8/16*** | (2006.01) |
| ***A43D 8/22*** | (2006.01) |
| ***A43D 95/06*** | (2006.01) |
| ***A43D 95/14*** | (2006.01) |
| ***A43B 3/00*** | (2006.01) |
| ***A43B 13/00*** | (2006.01) |
| ***B05B 13/02*** | (2006.01) |
| ***B05B 12/20*** | (2018.01) |

(52) U.S. Cl.

CPC ..... *A43D 8/16* (2013.01); *A43B 3/0078* (2013.01); *A43B 13/00* (2013.01); *A43D 8/22* (2013.01); *A43D 95/06* (2013.01); *A43D 95/14* (2013.01); *B05B 12/20* (2018.02); *B05B 13/02* (2013.01)

(58) Field of Classification Search

CPC ..... B05B 12/20; B05B 13/02; A43D 8/22; A43D 8/24; A43D 95/06; A43D 95/14

See application file for complete search history.

(56) References Cited

U.S. PATENT DOCUMENTS

| | | | |
|---|---|---|---|
| 2,168,243 | A | 8/1939 | Rollmann et al. |
| 2,341,715 | A | 2/1944 | Harrington et al. |
| 3,177,597 | A | 4/1965 | Davis, Jr. et al. |
| 3,274,628 | A | 9/1966 | Ralphs et al. |
| 3,372,415 | A | 3/1968 | King et al. |
| 3,846,533 | A | 11/1974 | Carrier |
| 3,855,657 | A | 12/1974 | Mazzotta et al. |

(Continued)

FOREIGN PATENT DOCUMENTS

| | | | |
|---|---|---|---|
| CN | 2515008 | Y | 10/2002 |
| GB | 2227434 | A | 8/1990 |

*Primary Examiner* — Ted Kavanaugh

(74) *Attorney, Agent, or Firm* — Shook Hardy & Bacon, LLP

(57) ABSTRACT

Aspects hereof relate to a holding fixture for holding portions of a shoe during painting. The fixture has a lower jig and an upper jig. The lower jig has an outer wall from which a contacting surface extends. The contacting surface is sized to apply a compressive force to the midsole along a desired paint line, and prevents paint from moving onto the midsole below the contacting surface. The top jig has a lower surface configured to be placed in contact with the top surface of the midsole when the midsole is held in the lower jig and is shaped to apply a downward and outward force on the midsole at an edge defined by the top surface of the midsole and the outer perimeter surface of the midsole, to thereby prevent paint from moving onto the top surface of the shoe portion.

14 Claims, 5 Drawing Sheets

(56) References Cited

U.S. PATENT DOCUMENTS

| | | | | |
|---|---|---|---|---|
| 3,965,517 | A * | 6/1976 | Auberry | A43D 9/00 12/142 RS |
| 4,217,081 | A | 8/1980 | Rooney | |
| 5,032,330 | A * | 7/1991 | Auberry | B29C 44/1271 264/244 |
| 5,702,774 | A | 12/1997 | Griffin et al. | |
| 7,922,948 | B2 * | 4/2011 | Sommerlund | A43B 9/04 264/244 |
| 2006/0175036 | A1 | 8/2006 | Guerrero | |
| 2015/0108683 | A1 | 4/2015 | Hausmann et al. | |
| 2015/0189951 | A1 | 7/2015 | Regan et al. | |
| 2015/0190830 | A1 | 7/2015 | Regan et al. | |
| 2015/0210028 | A1 | 7/2015 | Hansen | |
| 2015/0351499 | A1 | 12/2015 | James | |

* cited by examiner

PAINT FIXTURE FOR SHOE PORTIONS

CROSS-REFERENCE TO RELATED APPLICATIONS

This application is a divisional application of U.S. patent application Ser. No. 14/168,481, and entitled "PAINT FIXTURE FOR SHOE PORTIONS". The entirety of U.S. patent application Ser. No. 14/168,481 is incorporated herein by reference.

STATEMENT REGARDING FEDERALLY SPONSORED RESEARCH OR DEVELOPMENT

Not applicable.

TECHNICAL FIELD

Aspects hereof relate to fixtures used in holding objects for spray painting. More particularly, aspects relate to fixtures used to hold objects in a fixture when spray painting without the use of a masking tape, such as midsoles of shoe that are being painted in preparation for further assembly into a completed shoe.

BACKGROUND

Shoe construction today often involves a midsole component. Midsoles are often made from deformable materials that provide a cushioning for the wearer. Many midsole designs now require painting. Some designs feature a midsole with the entire side wall painted, while other designs feature a midsole with only a portion of the side wall painted. When the side wall of the midsole is painted, it is desirable to leave the foot bed free of paint for later assembly. In addition, any exposed paint lines should be clean and sharp. Existing methods for painting midsoles use a masking tape and a jig matched as closely as possible to the desired paint lines. The masking tape is manually applied and thus takes time and introduces possible inaccuracies for the paint lines. A need exists for improved painting fixtures for the midsoles of shoes.

BRIEF SUMMARY

The disclosed technology relates to a holding fixture for holding portions of a shoe during painting. The fixture has a lower jig and an upper jig. The lower jig has an outer wall from which a contacting surface extends. The contacting surface is sized to apply a compressive force to the midsole along a desired paint line, and prevents paint from moving onto the midsole below the contacting surface. The top jig has a lower surface configured to be placed in contact with the top surface of the midsole when the midsole is held in the lower jig and is shaped to apply a downward and outward force on the midsole at an edge defined by the top surface of the midsole and the outer perimeter surface of the midsole, to thereby prevent paint from moving onto the top surface of the shoe portion.

The disclosed technology also generally relates to a holding fixture for holding portions of a shoe, such as a midsole, during painting. The fixture has a lower jig, with left and right sides that are pivotally coupled together. Each side has an outer wall that, in connection with a lower support surface, defines a cavity, into which the shoe portion is placed for painting. The left and right sides of the lower jig have an upper surface that is configured to correspond with a desired paint line. Left and right blades are placed on the upper surfaces of the left and right sides, respectively. The blades are sized to exert an inward force on the portion of the shoe along the desired paint line. In use, the left and right sides are pivoted to an open position. The shoe portion is then positioned between the left and right sides. The left and right sides are then pivoted to a closed position, with the inner edges of the blades contacting an outer lateral surface of the shoe portion. A top jig is also provided that exerts a downward force on the shoe portion that prevents paint from moving onto the foot bed (top surface) of the shoe portion.

BRIEF DESCRIPTION OF THE DRAWING

Aspects hereof are described in detail below with reference to the attached drawing figures, wherein.

DETAILED DESCRIPTION

The subject matter of certain aspects hereof is described with specificity herein to meet statutory requirements. But the description itself is not intended to define what is regarded as an invention, which is what the claims do. The claimed subject matter may comprise different elements or combinations of elements similar to the ones described in this document, in conjunction with other present or future technologies. Terms should not be interpreted as implying any particular order among or between various elements herein disclosed unless explicitly stated.

Figure 1:
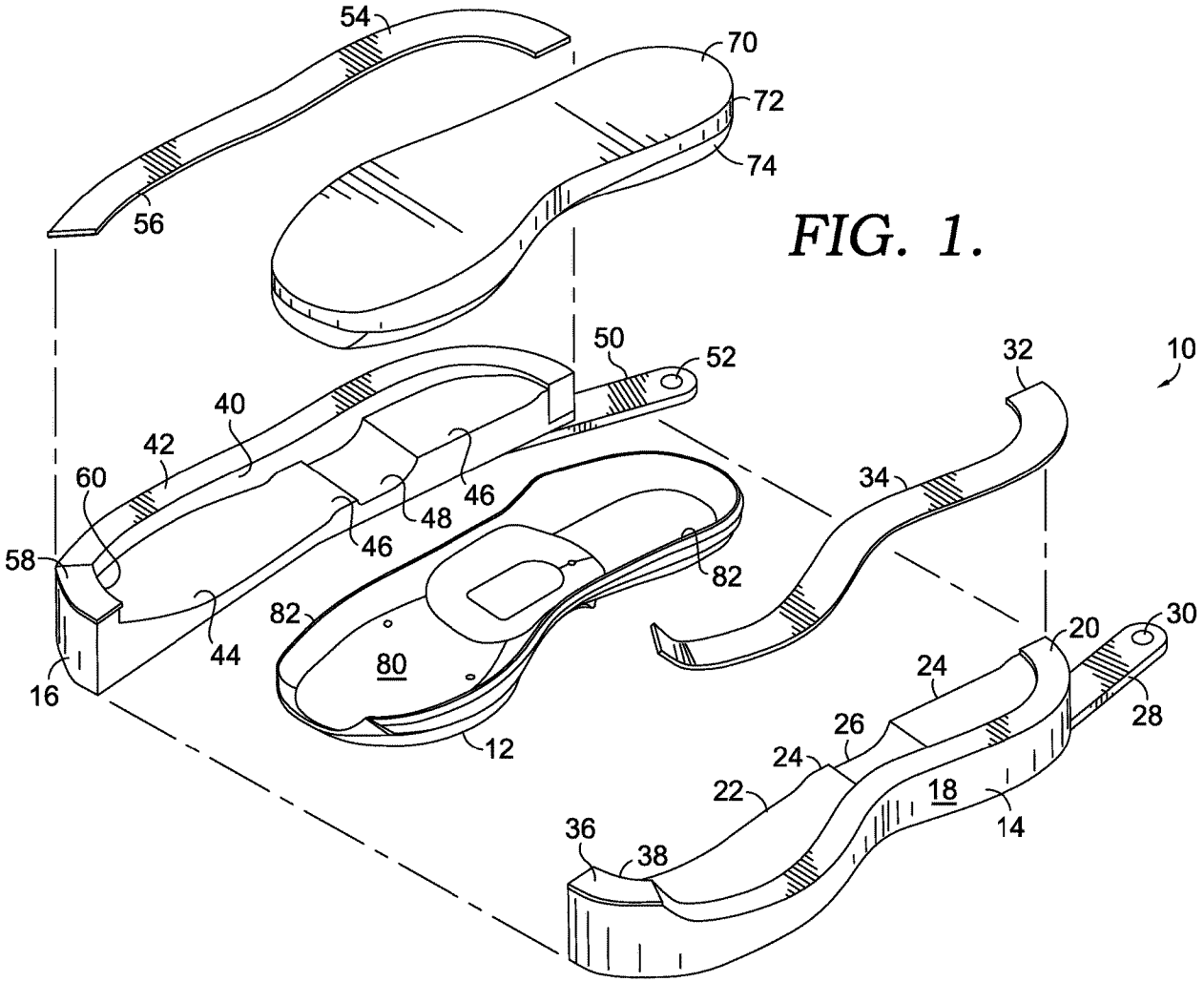
FIG. 1 is an exploded view of a midsole paint fixture and midsole.

Referring initially to FIG. 1, an exemplary paint fixture 10 is illustrated in an exploded view, along with an exemplary midsole 12. While midsole 12 is shown in a particular configuration, it should be understood that an almost limitless number of configurations for midsole 12 are possible. It follows that the possible specific configurations for fixture 10 are also almost limitless. However, the concepts discussed below are applicable across this variety of configurations. Broadly, the fixture 10 has a left side jig 14 and a right side jig 16. Together, the jigs 14 and 16 form the lower portion of the fixture 10. Left side jig 14 has an outer perimeter wall 18. Wall 18 has an upper surface 20 that has a contour corresponding generally to a desired paint line for a lateral wall of the midsole 12. A support surface 22 extends from the perimeter wall 18 of the left side jig 14. In some aspects, the support surface 22 is configured to have raised portions 24 and lowered portions 26. Portions 24 and 26 are positioned and shaped to affect a desired force on midsole 12 when fixture 10 is in a closed position. In some cases, the position and shape of portions 24 and 26 can therefore change with the configuration of any particular midsole 12. Left side jig 14 further has an arm 28 extending from a lower surface of the jig. Arm 28 has a hole 30, which is used as a connection point with right side jig 16, as further described below.

Figure 4:
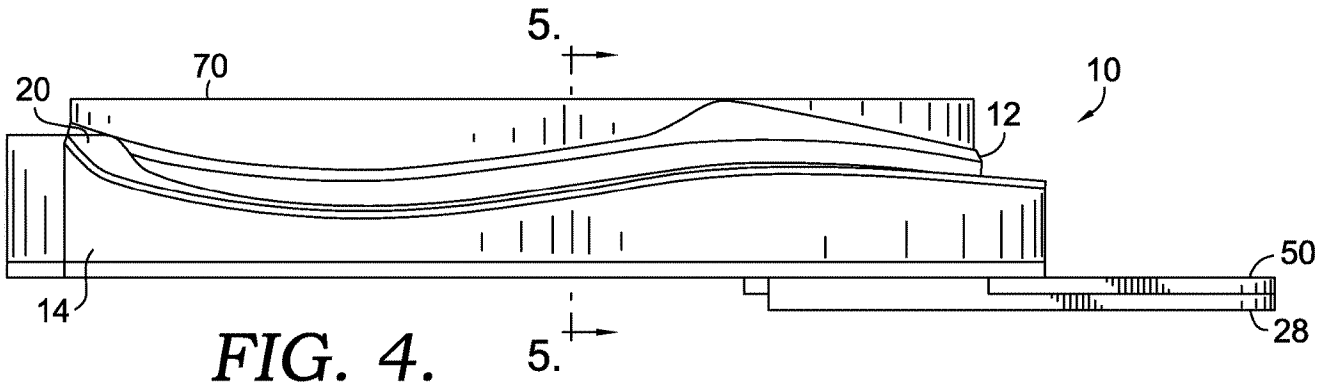
FIG. 4 is a side view of the assembly of FIG. 2.
Figure 6:
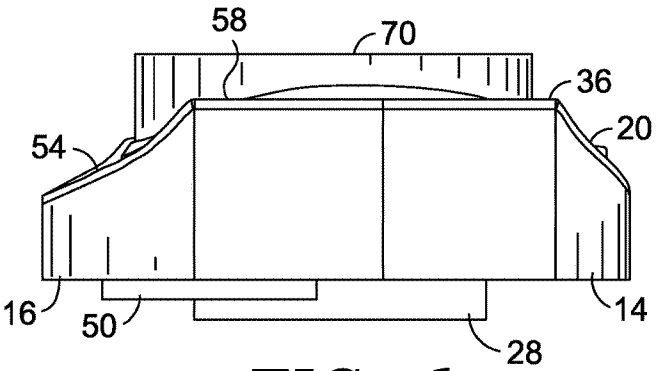
FIG. 6 is a front view of the assembly of FIG. 2.

A left side blade 32 is coupled to a portion of the upper surface 20 of wall 18. The blade 32 matches the contour of surface 20, and is wider than surface 20. Blade 32 is coupled to the surface 20 such that an inner edge 34 of the blade 32 extends inwardly beyond the edge of surface 20, as best seen in FIG. 4. Blade 32 can be formed and attached to surface 20 with adhesives, welding, fusing or other attachment schemes. Alternatively, jig 14 can be formed such that blade 32 is an integral portion of the jig. Similarly, a left side cover 36 is coupled to a portion of the upper surface 20 of wall 18. The cover 36 matches the contour of surface 20 at the front of jig 14. Cover 36 is coupled to the surface 20 such that an inner edge 38 of the cover 36 extends inwardly beyond the edge of surface 20. Cover 36 can be formed and attached to surface 20 with adhesives, welding, fusing or other attachment schemes. Alternatively, jig 14 can be formed such that cover 36 is an integral portion of the jig.

Figure 2:
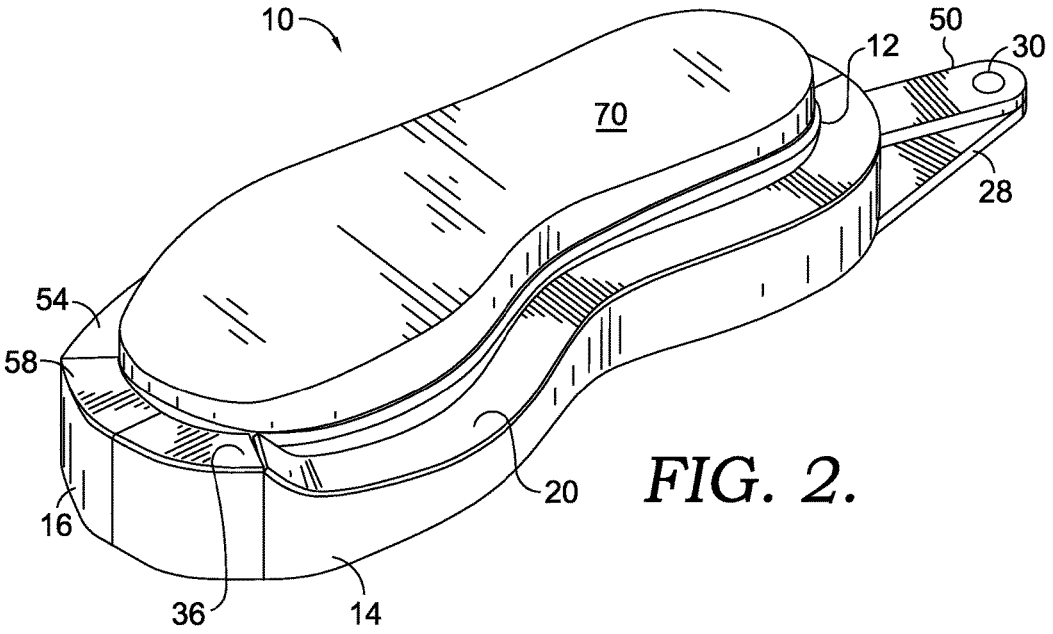
FIG. 2 is a perspective view of the midsole paint fixture and midsole of FIG. 1 but in an assembled condition.
Figure 3:
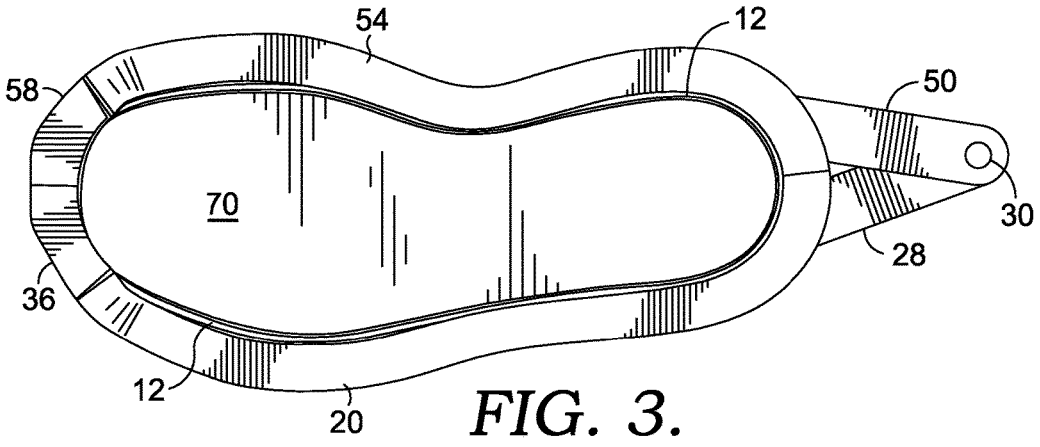
FIG. 3 is a top view of the assembly of FIG. 2.

Right side jig 16 is constructed similarly to left side jig 14. More specifically, right side jig 16 has an outer perimeter wall 40. Wall 40 has an upper surface 42 that has a contour corresponding generally to a desired paint line for the midsole 12. A support surface 44 extends from the perimeter wall 40 of the right side jig 16. In some aspects, the support surface 44 is configured to have raised portions 46 and lowered portions 48. Portions 46 and 48 are positioned and shaped to affect a desired force on midsole 12 when fixture 10 is in a closed position. In some cases, the position and shape of portions 46 and 48 can therefore change with the configuration of any particular midsole 12. Right side jig 16 further has an arm 50 extending from a lower surface of the jig. Arm 50 has a hole 52, which is used as a connection point with left side jig 14. More specifically, as seen in FIGS. 2 and 3, arms 28 and 50 are oriented with holes 30 and 52 in alignment with one another. In this aligned orientation, the arms 28 and 50 are pivotally coupled together, such that the left side jig 14 can be pivoted toward and away from the right side jig 16. This pivoting movement allows the lower portion of the fixture 10 to be opened and closed in operation.

Figure 5:
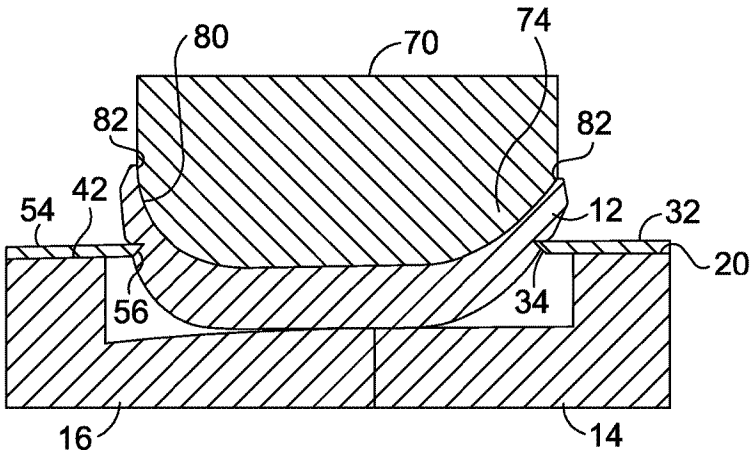
FIG. 5 is a sectional view taken along line 5-5 of FIG. 4.

A right side blade 54 is coupled to a portion of the upper surface 42 of wall 40. The blade 54 matches the contour of surface 42, and is wider than surface 42. Blade 54 is coupled to the surface 42 such that an inner edge 56 of the blade 54 extends inwardly beyond the edge of surface 42, as best seen in FIG. 5. Blade 54 can be formed and attached to surface 42 with adhesives, welding, fusing or other attachment schemes. Alternatively, jig 16 can be formed such that blade 54 is an integral portion of the jig. Similarly, a right side cover 58 is coupled to a portion of the upper surface 42 of wall 40. The cover 58 matches the contour of surface 42 at the front of jig 16. Cover 58 is coupled to the surface 42 such that an inner edge 60 of the cover 58 extends inwardly beyond the edge of surface 42. Cover 58 can be formed and attached to surface 42 with adhesives, welding, fusing or other attachment schemes. Alternatively, jig 16 can be formed such that cover 58 is an integral portion of the jig.

Returning to FIG. 1, the fixture 10 has a top jig 70 configured to work cooperatively with the left and right jigs 14, 16. Top jig 70 has an upper portion 72 and a lower portion 74. As best seen in FIG. 5, lower portion 74 has a contour configured to apply a slight outward force to selected top portions of midsole 12 when fixture 10 is assembled. As an example, this outward force is achieved by having a slightly greater radius of curvature that the curvature of the corresponding section of the top of midsole 12.

In use, the left jig 14 is coupled to the right jig 16 using the holes 30 and 52 in arms 28 and 50. Jigs 14 and 16 are therefore allowed to pivot toward and away from each other between open and closed positions. The blades 32 and 54, along with the covers 36 and 58 are coupled to the jigs at this point. With the jigs 14 and 16 pivoted away from one another, the midsole 12 can be positioned between jigs 14 and 16, with the bottom of the midsole 12 positioned in contact with the support surfaces 22 and 44. The jigs 14 and 16 can then be pivoted inwardly (toward each other), to a substantially closed position as seen in FIGS. 2-6. In this closed position, the support surfaces and the outer perimeter walls of jigs 14 and 16 form a cavity that contains a portion of the midsole 12. Midsole 12 is preferably made from a deformable material that provides a cushioning effect to the wearer of the shoe. Exemplary materials, without limitation, include polyurethane foam and expanded EVA (ethylene vinyl acetate) foam, although other materials offering similar properties could be used. In the closed position, as best seen in FIG. 5, the inner edges 34, 56 of blades 32 and 54 act as contacting surfaces that contact the side wall of the midsole and are "pressed into" the side wall, resulting in a slight deformation of the side wall by the blades. This deformation provides an effective masking of the side wall below the blades 32 and 54 without the need for manually applied masking tape. While not shown, it should be understood that some type of retaining mechanism may be used to hold the jigs 14 and 16 in the closed position. Exemplary mechanisms include latches, pins, clasps, hasps or other similar mechanisms.

With the jigs 14 and 16 held in the closed position, the top jig 70 is placed in contacting relationship with the foot bed 80 (see FIGS. 1 and 5) of the midsole 12. In this position, the lower portion 74 of the jig 70 exerts a downward and outward force on the foot bed 80 of the midsole 12. As best seen in FIG. 5, this force forms a more-positive seal between the upper edge 82 of the midsole 12 and the lower portion 74 of jig 70. This relationship between the jig 70 and midsole 12 operates to prevent paint from entering the foot bed 80. The jig 70 may be maintained in place due solely to its weight. However, the jig 70 may also be held in place with a clamping mechanism that is configured to apply a consistent downward pressure on the jig 70 to more-positively maintain the contact between the jig 70 and the midsole 12. The raised portions 24 and 46 of first and second jigs 14, 16 cooperate to apply desired forces to the midsole 12 to achieve a proper seal between the midsole 12 and the jigs 14 and 16. The lowered portions 26 and 48 of the first and second jigs 14, 16 are provided to allow expansion of portions of the midsole 12 as the midsole is compressed. While jigs 14 and 16 have been described as being pivotally coupled together, other ways to releasably couple the two jigs together could be used. For example, and without limitation, the two jigs could be coupled together along a slide, such that the two jigs slide open (away from one another) to receive midsole 88, and slide closed (towards one another) to a retaining position for midsole 88 similar to the closed position described above.

Figure 7:
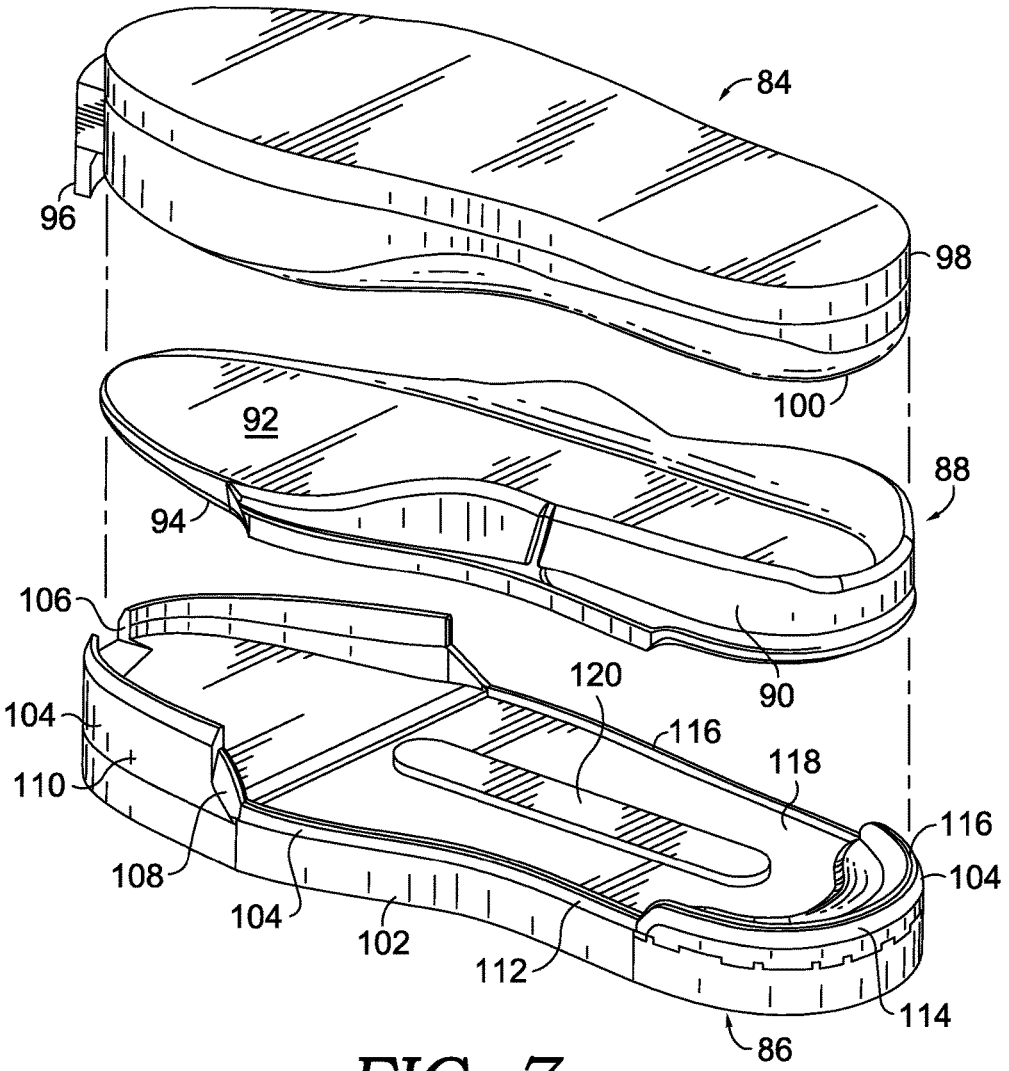
FIG. 7 is an exploded view of a midsole paint fixture and midsole.

FIGS. 7-10 show another construction of a paint fixture and midsole. As shown in FIG. 7, the paint fixture has a top jig 84 and a bottom jig 86 used to hold a midsole 88. The midsole 88 generally has a sidewall 90, a foot bed 92 and a lower surface 94. The construction of the paint fixture shown in FIGS. 7-10 can be used, in one example, when the full extent of sidewall 90 is to be painted while the foot bed 92 and lower surface 94 are not to be painted. While a midsole 88 is shown in some detail, it should be understood that an almost limitless number of variations of midsole 88 are possible, resulting in corresponding variations to top jig 84 and bottom jig 86.

Returning to FIG. 7, top jig 84 has an overall shape generally corresponding to the shape of midsole 88. Top jig 84 preferably has an alignment tab 96 that extends outwardly and downwardly from an outer wall 98 that has a curved lower portion 100. Curved lower portion 100 is configured to interact with the foot bed 92 and sidewall 90 as described in further detail below with respect to FIGS. 9 and 10.

Figure 8:
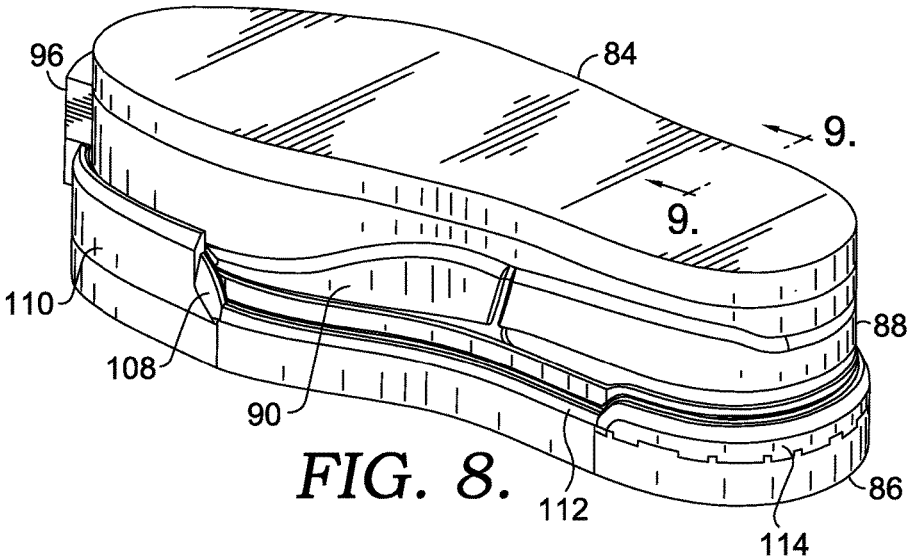
FIG. 8 is a view similar to FIG. 7 but with the top and bottom jigs in a partially-closed position.
Figure 9:
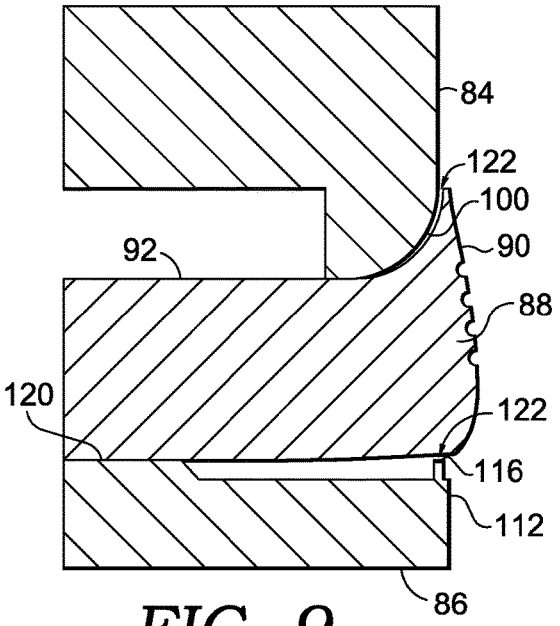
FIG. 9 is a partial cross section taken along line 9-9 of FIG. 8.
Figure 10:
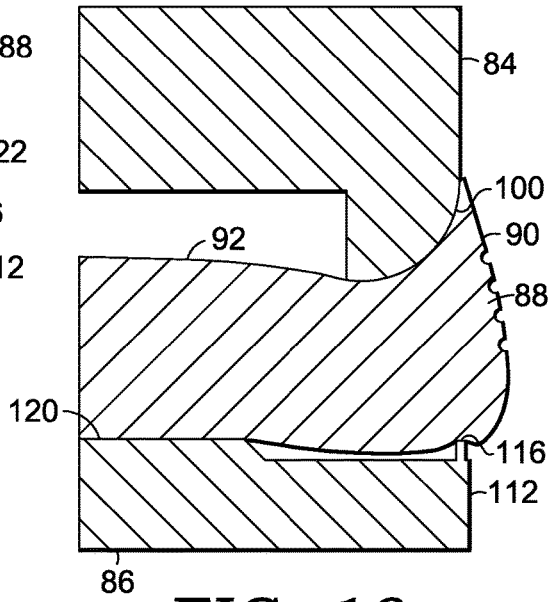
FIG. 10 is a view similar to FIG. 9, but with the top and bottom jigs in a fully-closed position.

Bottom jig 86 has a base section 102. Base section 102 can be of an overall shape that is similar to top jig 84, but need not be as other shapes are acceptable as well. A perimeter wall 104 extends upwardly from base section 102. The perimeter wall 104 may have different areas that extend upwardly more than others, depending on the desired paint scheme. For example, perimeter wall 104 may have some sections extending to completely mask midsole 88, such as sections 108 and 110. In other sections, perimeter wall 104 may be configured to partially mask midsole 88, allowing sidewall 90 to be painted, such as sections 112 and 114. Sections 112 and 114 may have a raised edge 116 extending therefrom, as best seen in FIGS. 7, 9 and 10. An alignment notch 106 is positioned within wall 104. In use, the alignment tab 96 of top jig 84 aligns with alignment notch 106 of bottom jig 86, with midsole 88 between jigs 84 and 86, as best seen in FIG. 8. Returning to FIG. 7, bottom jig 86 has a top surface 118 that may include a raised feature, such as 120, extending upwardly therefrom. The shape, location and overall size of any particular raised feature can be modified to influence the masking characteristics in cooperation with raised edge 116 and top jig 84.

In use, a midsole 88 is placed between top jig 84 and bottom jig 86, as shown in FIG. 7. Once top jig 84 and bottom jig 86 are aligned, using tab 96 and notch 106, the assembly will generally appear as shown in FIG. 8. In this configuration, the sidewall 90 of midsole 88 is roughly masked. As shown in FIG. 9, before any compression is imparted to jigs 84 and 86, the midsole 88 may not be tightly coupled between the jigs. For example, before compressing midsole 88 by moving jigs 84 and 86 towards one another, gaps 122 may be present, as shown in FIG. 9. Upon compression of midsole 88, gaps 122 are removed, as seen in FIG. 10. The area created by raised feature 120 and the raised edge 116 of perimeter wall 104 provide the midsole 88 an area into which it can expand, as can be seen by comparing FIGS. 9 and 10. This creates an effective mask line at the raised edge 116 which acts as a midsole contacting surface, to prevent paint from the lower surface 94 of midsole 88. Additionally, the curved lower portion 100 of outer wall 98 engages with midsole 88 adjacent the sidewall 90 on the side of the foot bed 92. Preferably, the radius of the curved lower portion 100 is slightly greater than the radius of the foot bed 92. This offset, along with a compressive force, creates an effective mask from paint, such that paint is prevented from entering the foot bed 92, while allowing the sidewall 90 to be painted. While not shown, the top jig 84 and bottom jig 86 may be placed in a fixture to apply the compressive force noted above. Any suitable fixture for holding fixtures 84 and 86, and moving them toward one another, can be used.

Many different arrangements of the various components depicted, as well as components not shown, are possible without departing from the scope of the claims below. Exemplary aspects of the present technology have been described with the intent to be illustrative rather than restrictive. Alternative aspects will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated to be within the scope of the claims.

Having thus described the invention, what is claimed is:

1. An apparatus for holding a shoe portion having a top surface, an outer perimeter surface for painting, and a bottom surface, the apparatus comprising:

a first jig having a first support surface and a first outer wall extending from the first support surface, the first outer wall having a first upper surface;

a second jig having a second support surface and a second outer wall extending from the second support surface, the second upper wall having a second upper surface, the first and second jigs removably coupled to one another and moveable between an open and a closed position such that a cavity is defined by the first and second support surfaces and the first and second outer walls;

a first blade coupled to the first upper surface, the first blade having a first inner edge that extends inwardly into the cavity;

a second blade coupled to the second upper surface having a second inner edge that extends inwardly into the cavity;

the first and second blades configured such that the first and second inner edges extend into the outer perimeter of the shoe portion when the first and second jigs are placed in the closed position;

wherein the first and second blades form a masking line, preventing paint from moving into the cavity below the first and second blades.

2. The apparatus of claim 1, further comprising:

a top jig having a lower surface, the lower surface of the top jig shaped to apply an outward force on an edge between the top surface of the shoe portion and the outer perimeter surface of the shoe portion, thereby preventing paint from moving onto the top surface of the shoe portion.

3. The apparatus of claim 1, wherein the first and second support surfaces of the first and second jigs have raised portions that apply an upward force to portions of the bottom surface of the shoe portion.

4. The apparatus of claim 3, wherein the first and second support surfaces of the first and second jigs have lowered portions that provide an expansion area for the shoe portion.

5. The apparatus of claim 4, wherein the first and second jigs are pivotably coupled.

6. The apparatus of claim 5, wherein the first blade is integrally formed with the first outer wall and the second blade is integrally formed with the second outer wall.

7. The apparatus of claim 6, further comprising a first front cover coupled to a front portion of the first outer wall, and a second front cover coupled to a front portion of the second outer wall, the first and second covers operable to prevent paint from moving to an area below the front covers.

8. An apparatus for holding a shoe portion, the shoe portion having a top surface, an outer perimeter surface for painting, and a bottom surface, the apparatus comprising:

a first jig having a first support surface and a first outer wall extending from the first support surface, the first outer wall having a first upper surface having a first inner edge that extends inwardly into the cavity;

a second jig having a second support surface and a second outer wall extending from the second support surface, the second upper wall having a second upper surface having a second inner edge that extends inwardly into the cavity, the first and second jigs moveable to form a cavity partially defined by the first and second support surfaces and the first and second outer walls;

wherein the first inner edge and the second inner edge form a masking line that prevents paint from moving into the cavity between the first upper surface and the first support surface.

9. The apparatus of claim 1, further comprising:

a top jig having a lower surface, the lower surface of the top jig shaped to apply an outward force on an edge between the top surface of the shoe portion and the outer perimeter surface of the shoe portion, thereby preventing paint from moving onto the top surface of the shoe portion.

10. The apparatus of claim 1, wherein the first and second support surfaces of the first and second jigs have raised portions capable to apply an upward force to portions of the bottom surface of the shoe portion.

11. The apparatus of claim 10, wherein the first and second support surfaces of the first and second jigs have lowered portions that provide an expansion area for the shoe portion.

12. The apparatus of claim 11, wherein the first and second jigs are pivotably coupled to one another.

13. The apparatus of claim 12, wherein the first inner edge and the second inner edge are integrally formed with the first and second outer walls.

14. The apparatus of claim 13, further comprising a first front cover coupled to a front portion of the first outer wall, and a second front cover coupled to a front portion of the second outer wall, the first cover and the second cover operable to prevent paint from moving to an area below the front covers.

* * * * *